United States Patent [19]

Collins

[11] Patent Number: 4,684,803

[45] Date of Patent: Aug. 4, 1987

[54] ELECTRODE SEGMENTS FOR CORONA DISCHARGE DEVICES

[75] Inventor: Wayne Collins, Oconomowoc, Wis.

[73] Assignee: Pillar Technologies, Inc., Hartland, Wis.

[21] Appl. No.: 806,464

[22] Filed: Dec. 9, 1985

[51] Int. Cl.[4] ..... H01T 19/04

[52] U.S. Cl. ..... 250/324; 250/325

[58] Field of Search ..... 250/324, 325, 326

[56] References Cited

U.S. PATENT DOCUMENTS

| | | | |
|---|---|---|---|
| 4,016,813 | 4/1977 | Pressman et al. | 250/325 |
| 4,533,523 | 8/1985 | Ahlbrandt | 250/325 |
| 4,556,795 | 12/1985 | Tietje | 250/324 |
| 4,564,759 | 1/1986 | Tietje | 250/324 |

*Primary Examiner*—Bruce C. Anderson

*Attorney, Agent, or Firm*—Ronald E. Barry

[57] ABSTRACT

A corona discharge device having a roll electrode and a segmented corona discharge electrode assembly mounted in a spaced relation to the roll electrode, the electrode assembly including a number of electrode segments mounted in a staggered relation with respect to said roll electrode, each segment including a hollow tubular electrically conductive electrode and a cup-shaped insulator mounted on the end of the electrode, the insulator including a base having an opening in the center, a tubular wall section surrounding the outside of the electrode and a vent tube aligned with the opening in the base and extending into the electrode to provide a vent passage for drawing air or blowing air across the face of the surface of the base of the insulator, and an electricity conductive adhesive for securing the insulator to the electrode and providing an even electrical field between the base and the surface of the base race electrode.

19 Claims, 7 Drawing Figures

ELECTRODE SEGMENTS FOR CORONA DISCHARGE DEVICES

BACKGROUND OF THE INVENTION

Corona Discharge Devices are used to treat the surface of various materials such as polyethylene film by passing the film between a pair of electrodes. Generally one of the electrodes comprises a metallic roll which is used to carry the film through the discharge zone and a segmented electrode assembly pivotally mounted for movement between an operative position spaced from the rod electrode and an inoperative position for maintenance or repair. The electrode assembly includes a plurality of electrode segments having square metallic electrodes mounted on a common base with a hollow ceramic or insulating member mounted on the end of each of the electrodes. The electrode segments are offset one from the other to provide a corona discharge across the entire surface of the film. One of the problems with this type of a corona discharge device is the production of striping on the film due to the uneven exposure of the film to the corona discharge field produced by the square segments. Cooling of the segments has also been a problem since the highest temperature occurs in the corona discharge field or zone between the two electrodes. Finally, the spacing in the gap between the electrodes is difficult to control because of the variations in thickness of the ceramic members.

SUMMARY OF THE PRESENT INVENTION

The corona discharge device, according to the present invention, utilizes a plurality of electrode segments each having a cylindrical ceramic insulator mounted on the end of a hollow metallic tubular member. When properly spaced, a substantially even corona field will be provided across the film which will substantially reduce the amount of striping on the film. The hollow tubular conductive members are threaded at one end to allow for easy adjustment with respect to the mounting plate and are locked in position to provide very accurate spacing between electrodes. This also allows for easy removal or replacement of the electrode segments in the event of failure or to eliminate electrode segments from the mounting plate.

Cooling has been enhanced by providing an air hole in the base of the cylindrical ceramic insulator which is aligned with the axis of the hollow tubular member to allow for the air on the face of the electrode segment to be pulled through the electrode for discharge from the apparatus. An even corona discharge field is provided between the face of each electrode segment and the roll electrode by utilizing a conductive adhesive as the material for securing the ceramic insulator onto the end of the tubular member.

IN THE DRAWINGS

DESCRIPTION OF THE INVENTION

Figure 1:
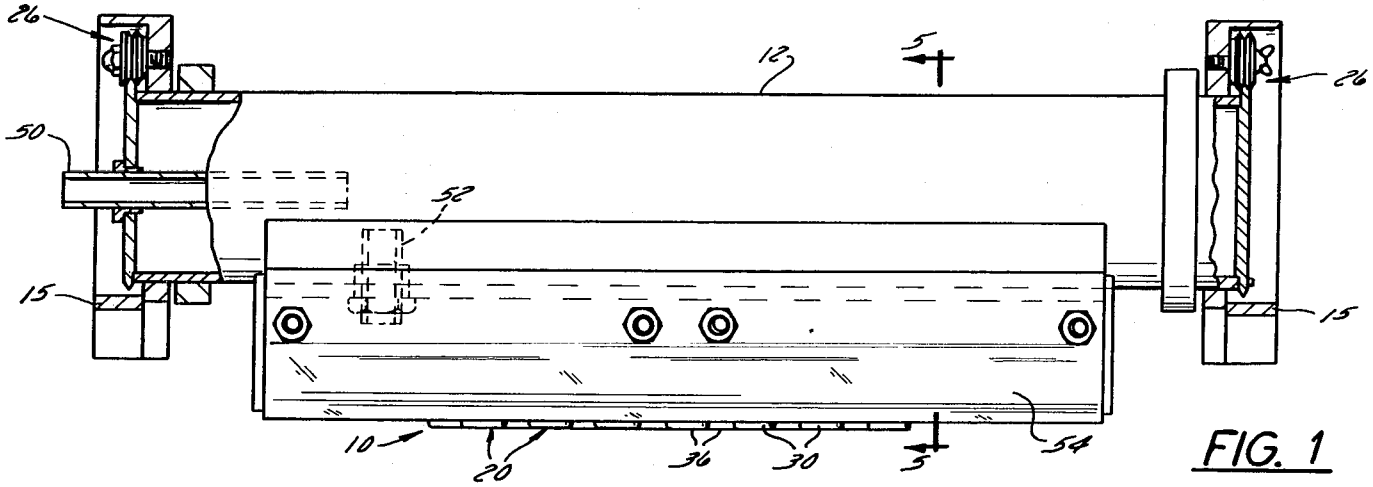
FIG. 1 is a front elevation view of a corona discharge device showing the segmented electrode assembly mounted on the evacuation tube in a spaced relation to the roll electrode.
Figure 2:
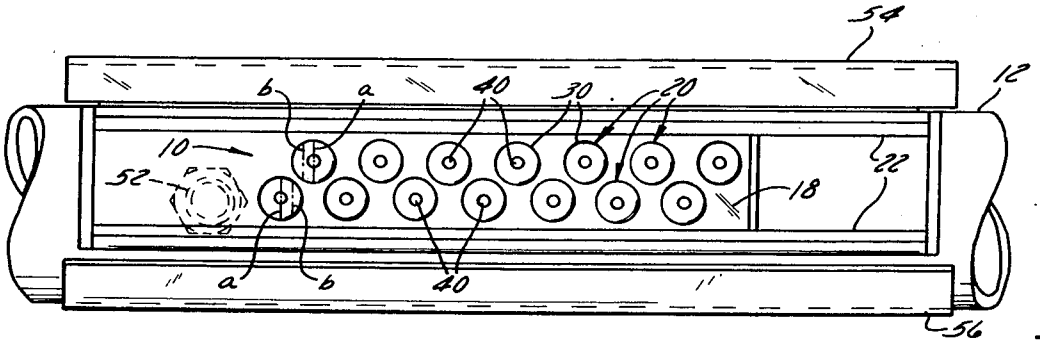
FIG. 2 is a view showing the segmented assembly pivoted away from the roll electrode to show the staggered spacing of the electrode segments.
Figure 3:
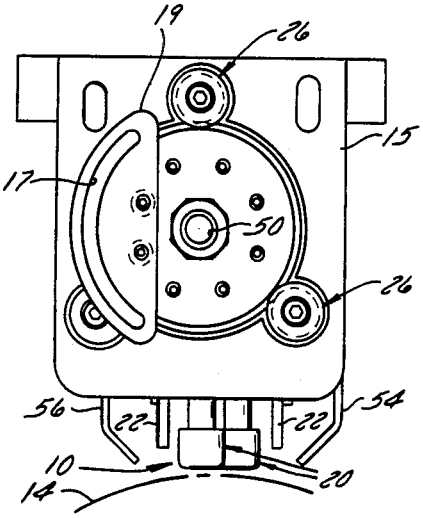
FIG. 3 is a left end view of the corona discharge device.
Figure 4:
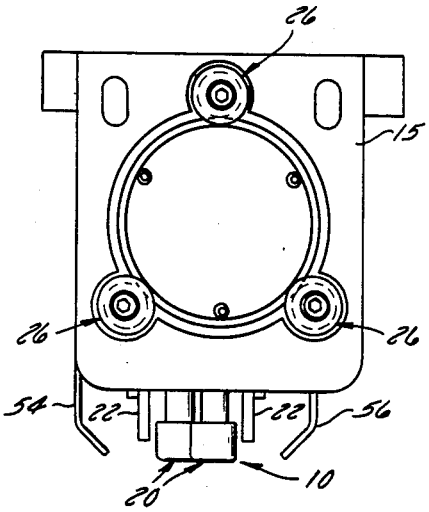
FIG. 4 is a right end view of the corona discharge device.
Figure 5:
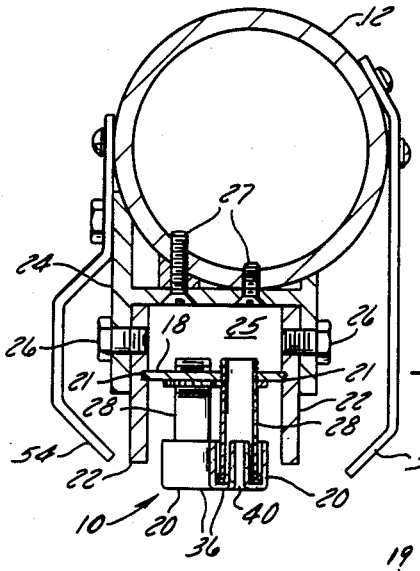
FIG. 5 is a view taken generally along line 5—5 of FIG. 1.

Referring to FIGS. 1 and 2 of the drawings, the segmented electrode assembly 10 according to the invention, is shown mounted on an air evacuation tube 12 in a spaced relation to an electrically conductive bare roll electrode 14. The evacuation tube 12 is mounted for rotary motion on roller assemblies 26 supported on a frame or base 15 and located at each end of the tube 12. The evacuation tube 12 can then be rotated within the limits of slot 17 in plate 19 which is mounted on the frame 15. This allows for rotation of the electrode assembly 10 for replacement or repair.

The segmented electrode assembly 10 includes a number of electrode segments 20 located in a spaced relation to the surface of the conductive roll electrode 14. In operation, a suitable electrical power supply is coupled to the electrode segments 20 and the conductive roll electrode 14 to produce a corona discharge field in the gap between the electrode segments and the bare roll electrode 14. The electrode segments 20 are mounted on a mounting plate 18 which is supported between a pair of sidewalls 22 secured to a support member 24 by means of bolts 26. The support member 24 is secured to the evacuation tube 12 by bolts 27. The electrode segments 20 are mounted on the plate 18 in a staggered relation as seen in FIG. 2.

Figure 6:
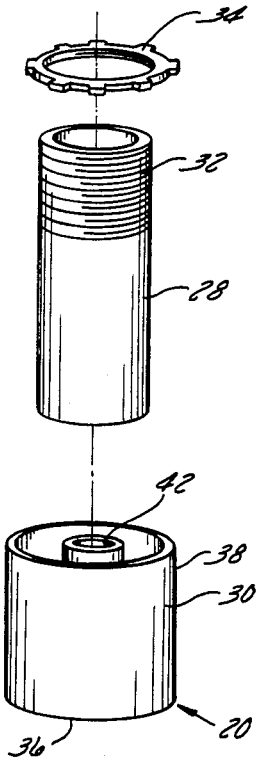
FIG. 6 is an exploded perspective view of an electrode segment.
Figure 7:
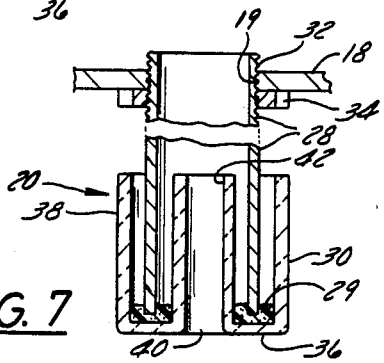
FIG. 7 is a cross section view of an electrode segment.

In this regarted and referring to FIGS. 6 and 7, each of the electrode segments 20 includes a hollow tubular electrically conductive member 28 and a cylindrical insulator 30. The tubular member includes a threaded section 32 at one end. A jam nut 34 is provided on the threaded section for locking the member 28 to the mounting plate 18. The tubular member 28 is insulated at the other end by means of the cylindrical insulator 30 which is in the form of a cup having a circular base 36 and integral tubular walls 38. The cup is formed from a glass or ceramic material of sufficient height to prevent shorting between the bare roll electrode and the conductive member 28.

In accordance with one aspect of the invention, the cup is vented by means of an opening 40 in the circular base 36 in order to draw air toward the center of the base of the insulator 30. The opening 40 is aligned with a hollow vent tube 42 provided as an integral part of the insulator. The tube 42 extends axially upward to the height of the wall 38 to prevent shorting of the member 28 with the bare roll electrode 14 through the opening 40. With this arrangement, air is drawn through the vent tube into the vent space 25 located above the mounting plate 18 thereby cooling the high temperature area of the corona discharge field in the gap between the electrode segments 20 and the roll electrode 14.

The insulators 30 are secured to the tubular members 28 by means of an electrically conductive adhesive 29. The adhesive is a conventional material designated by Emerson and Cummings Corporation as 83C-1 adhesive. The adhesive not only provides the means for securing the tubular member 28 to the insulator 30 but also provides the means for distributing the electrical field evenly across the bottom of the insulator 30. In this regard it should be noted that the corona field is produced in the gap between the end of the conductive member 28 and the roll electrode 14. By spreading the conductive adhesive across the bottom on the inside of the insulators 30, an even distribution of the electrostatic field will be produced between each of the segments 20 and the surface of bare roll electrode 14. This is important in order to minimize stripping of the treated material as described hereinafter.

Electrical communication to the electrode segments 20 is provided by means of the mounting plate 18 which is provided with a plurality of threaded holes 19. The edges of the mounting plate are seated in grooves 21 in the sidewalls 22. A vent space 25 is thereby defined by the sidewalls 22, mounting plate 18 and support member 24. The tubular members 28 are adjustably mounted in the threaded holes 19 in the mounting plate 18 by means of the threaded sections 32. In this regard it should be noted that the jam nuts 34 are mounted on the threaded sections 32. The member 28 after assembly to the insulator 30 are screwed into the threaded holes 19 and locked into the holes by means of the jam nuts 34. The distance of the bottom of the insulators 30 to the surface of the mounting plate can be accurately located within + or −0.005 inches.

Referring to FIG. 2, a bottom view is shown of the electrode segments 20. It should be noted that the lines of travel of the material is arranged so that maximum exposure to corona discharge will occur where the film passes through the full diameter "a" of the bottom of each of the electrode segments. In the space between the full diameter lines "a" and the line "b" the amount of exposure will drop off slightly. In the space between lines "b," the film will first pass over a major portion of one cylinder and a minor portion of the second cylinder which in total will be slightly less than the length of lines "a." This relationship will therefore provide a variation in exposure equal only to the difference between the length of lines "a" and "b." This is in contrast to the conventional system where the electrode segments are in the form of squares and the film will pass the width of one square and in the transition to the next segment will be exposed to two full squares and then back to the width of one full square.

Air is drawn through the electrodes by means of a vacuum pipe 50 mounted on the end of the evacuation tube 12 and an interconnecting tube 52 provided between the evacuation tube 12 and the space 25 in member 24. Shields 54 and 56 can be provided on each side of the evacuation tube 12. Air drawn through the vent tube 42 assures that the hotter air is vented from the face of the insulators and also acts to cool the interior of the electrodes. The vent holes are large enough to prevent clogging by any material generally found in this type of device.

Although the cup-shaped insulators have been disclosed as cylindrical herein it is within the contemplation of this application to use elliptical or diamond-shaped insulators. The insulators should be arranged so that the major dimensions in the direction of travel of the material do not fall in line and the minor dimensions overlap to provide a substantially even corona discharge field across the path of motion of the material being treated.

The embodiments of the invention in which an exclusive property or privilege is claimed are defined as follows:

1. An electrode segment for a corona discharge device, said segment comprising, a hollow tubular electrically conductive member, a cup-shaped insulator mounted on one end of said conductive member, said insulator having a base with an opening therein and a portion fitted into said conductive member, and means for securing said insulator to said conductive member with said opening in the base aligned with the center of said conductive member whereby a cooling medium passing through said opening will pass through the hollow tubular conductive member.

2. The segment according to claim 1 wherein said portion of said insulator comprises a hollow vent tube extending from said opening in the base into said conductive member for venting the cooling medium from the face of the insulator will pass through the electrically conductive member.

3. The segment according to claims 1 or 2 wherein said securing means comprises an electrically conductive adhesive for securing said insulator to said one end of the conductive member, said adhesive covering the inside surface of said base of the insulator to provide a continuous electrostatic field across the bottom of the insulator.

4. The segment according to claims 1 or 2 wherein said insulator is cylindrical.

5. A corona discharge device including a first metallic roll electrode for transporting a material to be treated, a segmented electrode assembly mounted in a spaced relation to said roll electrode, and a power supply connected to the roll electrode and the second electrode for producing a corona discharge field in the gap between the roll electrode and the fixed electrode, said segmented electrode assembly including a mounting plate having a plurality of holes spaced in a predetermined relation, and a plurality of electrode segments mounted on said mounting plate, each electrode segment including an electrically conductive hollow tubular member having one end of each of said conductive members being mounted in and of the holes in the mounting plate and a cup-shaped insulator mounted on the other end of each of the conductive tubular members and a portion of said insulator fitted into said conductive tubular member, said insulator including a base having a hole therein aligned with the center of the conductive members whereby a cooling medium passing through the hole in the insulator will also pass through the conductive member and a wall surrounding the tubular member in a spaced relation thereto, said electrode segments being staggered to provide a substantially even exposure of the material to be treated by the corona discharge field created between said electrode segments and said roll electrode.

6. The electrode assembly according to claim 5 wherein said cup insulator includes an opening in the base of said cup insulator which is in alignment with the tubular member and a vent tube mounted in the interior of the insulator to vent air drawn through the opening into said tubular member.

7. The electrode assembly according to claims 5 or 6 including adhesive means for securing said tubular member to said cup-shaped insulator.

8. The electrode assembly according to claim 7 wherein said adhesive means is electrically conductive to provide an even electrical field across the bottom of the insulator.

9. The assembly according to claims 5 or 6 wherein said insulators are cylindrical.

10. The assembly according to claim 9 including an electrically conductive adhesive on the bottom of said insulator to secure the insulator to the tubular member.

11. A corona discharge device comprising a frame a bare roll electrode mounted on said frame, an air evacuation tube mounted on said frame, and a segmented electrode assembly mounted on said air evacuation tube, said assembly including an electrically conductive mounting plate, and a plurality of electrode segments mounted on said mounting plate, each electrode segment including a hollow conductive tubular member and a cup-shaped insulator mounted on the end of the tubular member and having a portion fitted into said conductive member, said segment being positioned in a spaced relation to said roll electrode, means for venting gases from the space between said cup-shaped insulator and said roll electrode through said hollow conductive tubular member whereby said insulators prevent shorting between said conductive tubular members and said roll electrode.

12. The device according to claim 11 wherein said venting means comprises an opening in said insulator in alignment with said conductive tubular member.

13. The device according to claims 11 or 12 including means for pivotally mounting said evacuation tube on said frame whereby said segmented assembly can be rotated away from said roll electrode for maintenance and repair.

14. The device according to claims 11 or 12 including an electrically conductive adhesive in the bottom of said insulators for securing said insulator to said tubular member.

15. The device according to claims 11 or 12 including means for adjustably mounting said tubular members in said mounting plate whereby the spacing between said segments and said roll electrode can be adjusted.

16. The device according to claim 15 wherein said adjusting means comprises a threaded section at one end of said tubular member.

17. The device according to claim 11 wherein said insulators includes a circular base and a cylindrical wall formed integral with said base and positioned in a spaced relation to said hollow tubular member, said wall being of sufficient height to prevent shorting between said tubular member and said bare electrode.

18. The device according to claim 17 including an opening in said base aligned with said hollow conductive tubular member whereby air can be passed through said opening and said tubular member to cool the electrode segments.

19. The device according to claim 18 wherein said portion comprises an inner tubular member formed integral with said base to define a vent passage through said opening into said conductive member.

* * * * *